US011235546B2

(12) United States Patent
Pettersson

(10) Patent No.: US 11,235,546 B2
(45) Date of Patent: Feb. 1, 2022

(54) METHOD AND DEVICE FOR SEALING A JOINT

(71) Applicant: Packsize LLC, Salt Lake City, UT (US)

(72) Inventor: Niklas Pettersson, Västerås (SE)

(73) Assignee: PACKSIZE LLC, Salt Lake City, UT (US)

( * ) Notice: Subject to any disclaimer, the term of this patent is extended or adjusted under 35 U.S.C. 154(b) by 330 days.

(21) Appl. No.: 16/461,169

(22) PCT Filed: Oct. 27, 2017

(86) PCT No.: PCT/US2017/058734
§ 371 (c)(1),
(2) Date: May 15, 2019

(87) PCT Pub. No.: WO2018/093551
PCT Pub. Date: May 24, 2018

(65) Prior Publication Data

US 2020/0061950 A1 Feb. 27, 2020

(30) Foreign Application Priority Data

Nov. 21, 2016 (SE) ..... 1651520-7

(51) Int. Cl.
*B31B 50/72* (2017.01)
*B31B 100/00* (2017.01)
(Continued)

(52) U.S. Cl.
CPC ..... *B31B 50/722* (2017.08); *B31B 50/726* (2017.08); *B31B 2100/002* (2017.08);
(Continued)

(58) Field of Classification Search
CPC ..... B31B 50/722; B31B 2100/002; B31B 2110/35; B31F 5/06; B65B 51/06; B65B 13/025; B65H 35/004
See application file for complete search history.

(56) References Cited

U.S. PATENT DOCUMENTS 1,993,205 A 3/1935 Bowersock et al.
2,068,163 A 1/1937 Bowersock et al.
(Continued)

FOREIGN PATENT DOCUMENTS

DE 19518273 A1 12/1996
FR 2588506 A3 4/1987
(Continued)

OTHER PUBLICATIONS

International Search Report and Written Opinion, European International Search Authority, PCT/US2017/058734, dated Feb. 9, 2018.

*Primary Examiner* — Anna K Kinsaul
*Assistant Examiner* — Daniel Jeremy Leeds
(74) *Attorney, Agent, or Firm* — Workman Nydegger

(57) ABSTRACT

A method and a sealing device for sealing a joint (5; 31) between two end sides (3, 13) of two contiguous panels (1, 11). The method comprises the steps of: holding (S1) an end side (3) of a first panel (1) close to an end side (13) of a second panel (11), whereby the joint (5; 31) to be sealed is defined by the adjacent end sides (3, 13) of the two panels (1, 11); sealing (S3) the joint (5; 31) with a first and a second adhesive tape (15, 17) by providing a first tape (15) to a first face (19) of the two panels (1, 11), said first tape (15) sealing the joint (5; 31) and being provided in the direction of the joint and providing a second tape (17) to a second face (21) of the two panels (1, 11), wherein the second face (21) of the two panels (1, 11) is the opposite face to the first face (19)
(Continued)

of the panels, said second tape (17) sealing the joint (5; 31) and being provided in the direction of the joint.

20 Claims, 8 Drawing Sheets

(51) Int. Cl.
*B31B 110/35* (2017.01)
*B31F 5/06* (2006.01)
*B65B 51/06* (2006.01)

(52) U.S. Cl.
CPC ..... *B31B 2110/35* (2017.08); *B31F 5/06* (2013.01); *B65B 51/06* (2013.01)

(56) References Cited

U.S. PATENT DOCUMENTS

| | | | | |
|---|---|---|---|---|
| 2,795,263 | A | 6/1957 | Arvid | |
| 3,623,933 | A * | 11/1971 | Staats | B32B 27/00 156/552 |
| 2005/0028835 | A1 * | 2/2005 | Husband | B65H 35/004 132/270 |
| 2009/0298662 | A1 | 12/2009 | Maeaettae et al. | |

FOREIGN PATENT DOCUMENTS

| | | | |
|---|---|---|---|
| FR | 2772303 | A1 | 6/1999 |
| JP | H09 240626 | A | 9/1997 |
| WO | 2007/135234 | A1 | 11/2007 |
| WO | 2013/103722 | A1 | 7/2013 |

* cited by examiner

METHOD AND DEVICE FOR SEALING A JOINT

CROSS-REFERENCE TO RELATED APPLICATIONS

This application claims priority to PCT Application No. PCT/US2017/058734 filed Oct. 27, 2017, entitled "A Method and Device for Sealing a Joint," which claims the benefit of and priority to Sweden Patent Application No. 1651520-7, filed on Nov. 21, 2016. All the aforementioned applications are incorporated by reference herein in their entirety.

TECHNICAL FIELD OF THE INVENTION

The present invention relates to a method and a sealing device for sealing a joint between two end sides of two contiguous panels. It also relates to two contiguous panels sealed together and to a corrugated box.

BACKGROUND OF THE INVENTION

When sealing two end sides of two relatively flat panels to each other a tape or glue would be a common choice for performing the sealing. A problem with glue is that it takes some time for the glue to dry and provide the sealing effect and the providing of glue may also require some equipment. A tape may not be strong enough for keeping the panels together.

One example of when two panels need to be sealed together is when a manufacturer's joint in a corrugated box is sealed. The manufacturer's joint is a joint in the side walls in a corrugated box which historically is sealed already by the manufacturer of the box while bottom and top of the box are left open for a user to close later when the box is erected. The manufacturer's joint is a joint sealing the two outermost panels of a box template such that four side walls of a box is formed while top and bottom ends of the box still are open. Furthermore systems have been developed for creating custom sized boxes. In that case the user of the box may seal also the manufacturer's joint himself. If glue is used for sealing the manufacturer's joint a glue tab is provided in the box template which is an extra part of the side walls of the box, i.e. at some position of the side walls of the box the panels are overlapping forming the manufacturer's joint, which is sealed by glue. If instead tape is used for sealing the manufacturer's joint no glue tab is needed. The panels are instead provided adjacent each other and tape is provided for sealing the joint. This is described in for example WO 2013/103722.

SUMMARY

An object of the invention is to provide an improved method for sealing two panels to each other.

A further object of the invention is to provide an improved corrugated box.

A further object of the invention is to provide a method and a device for sealing two panels to each other which method and device is easy to use and provides a strong seal between the panels.

A further object of the invention is to provide an improved method and a device for sealing a manufacturer's joint of a corrugated box.

This is achieved in a method, a device, two panels and a corrugated box according to the independent claims.

This will provide a strong seal of a joint because tape is provided from both sides. Furthermore a robust, reliant and easy to manage method is provided. Furthermore a compact, cheap and easy to handle device for sealing the joint is achieved.

According to one aspect of the invention a method is provided for sealing a joint between two end sides of two contiguous panels, said method comprising the steps of:

- holding an end side of a first panel close to an end side of a second panel, whereby the joint to be sealed is defined by the adjacent end sides of the two panels;
- sealing the joint with a first and a second adhesive tape by providing a first tape to a first face of the two panels, said first tape sealing the joint and being provided in the direction of the joint and providing a second tape to a second face of the two panels, wherein the second face of the two panels is the opposite face to the first face of the panels, said second tape sealing the joint and being provided in the direction of the joint.

According to another aspect of the invention two contiguous panels which are sealed together are provided, whereby a joint which is sealed is defined by adjacent end sides of the two panels, whereby the seal has been provided by a first tape provided to a first face of the two panels, said first tape sealing the joint and being provided in the direction of the joint and by a second tape provided to a second face of the two panels, wherein the second face of the two panels is the opposite face to the first face of the panels, said second tape sealing the joint and being provided in the direction of the joint.

According to another aspect of the invention a corrugated box is provided, said corrugated box having a manufacturer's joint, wherein the manufacturer's joint has been sealed by a first tape provided to a first face of the side of the corrugated box comprising the manufacturer's joint, said first tape sealing the manufacturer's joint and being provided in the direction of the manufacturer's joint and by a second tape provided to a second face of the side of the corrugated box comprising the manufacturer's joint, wherein the second face is the opposite face to the first face, said second tape sealing the manufacturer's joint and being provided in the direction of the manufacturer's joint.

According to another aspect of the invention a sealing device is provided for sealing a joint between two end sides of two contiguous panels, said sealing device comprising:

- a first part comprising a first tape dispenser arranged for providing a first adhesive tape to a first face of the two panels, said first tape sealing the joint and being provided in the direction of the joint when the two panels are passing through the sealing device;
- a second part comprising a second tape dispenser arranged for providing a second tape to a second face of the two panels, wherein the second face of the two panels is the opposite face to the first face of the panels, said second tape sealing the joint and being provided in the direction of the joint when the two panels are passing through the sealing device; wherein
- said first and second parts of the sealing device are connected to each other such that the first and second tapes are provided simultaneously to the panels when the panels are passing between the first and second parts of the sealing device thereby sealing the joint from both faces of the panels.

In one embodiment of the invention the step of sealing the joint with a first and a second tape further comprises providing the first and second tapes over the whole length of the joint and further extending a distance outside the panels on one or both sides and the method further comprises the step of attaching the two tapes to each other where the tapes are extending outside the joint. In one embodiment of the invention two contiguous panels are provided which are sealed together, wherein the first and second tapes are extending outside the panels on one or both sides and in one embodiment of the invention a corrugated box is provided wherein the first and second tapes are extending outside the manufacturer's joint on one or both sides. Hereby an extra durability is provided to the sealing. Furthermore when the two adhesive sides of the two tapes attach to each other outside the joint the risk that the tapes will be teared off is decreased. The double tape will also protect the panels from wearing, especially at the ends of the joint.

In one embodiment of the invention the method is a method for sealing a manufacturer's joint in a corrugated box.

In one embodiment of the invention the step of sealing the joint with a first and a second tape comprises providing the first and second tapes to the joint simultaneously.

In one embodiment of the invention the step of sealing the joint comprises passing the panels between two connected tape dispensers.

In one embodiment of the invention the method further comprises the step of automatically releasing a cutter arrangement for cutting the tapes off when the tape dispensers are at a certain distance from the panels after the sealing of the joint.

In one embodiment of the invention a sealing device is provided wherein the first and second parts of the sealing device are connected to each other by a transverse member such that the two panels to be joined can be passing between the first and second parts with the transverse member fitting in the joint, hereby there will be a distance between the two panels in the joint which distance corresponds substantially to a width of the transverse member.

In one embodiment of the invention the first and second tape dispensers each comprises a tape roll and an applicator roll, whereby tape from the tape roll is provided onto the panels by the applicator roll and the two applicator rolls will be provided close to each other allowing the two panels to pass between them whereby the first and second tapes will be provided to the panels while they are passing between the applicator rolls.

In one embodiment of the invention at least one of the applicator rolls is provided spring loaded such that by loading a spring the spring loaded applicator roll can be forced away from the other applicator roll thus allowing the panels to pass between the applicator rolls.

In one embodiment of the invention the sealing device further comprises a cutter arrangement arranged for cutting the two tapes at a certain distance from the panels.

In one embodiment of the invention the cutter arrangement is spring loaded and comprises an extending part arranged for sliding over a surface of the panels when they are passing through the sealing device, said extending part keeping a cutting part of the cutter arrangement in an inactive position as long as the extending part is in contact with the panels and when the panels have passed the sealing device and the extending part no longer is in contact with the panels the spring force will bring the cutting part into a cutting position where the two tapes are cut off.

In one embodiment of the invention at least one of the applicator rolls is driven by a motor which can be controlled in dependence of output from a sensor which can detect the presence of a panel in the sealing device.

In one embodiment of the invention the sealing device further comprising guiding wheels protruding into an opening between the first and second parts which opening the panels are passing through during sealing of the joint, said wheels being oriented for guiding the two panels towards each other during their passing through the sealing device.

DETAILED DESCRIPTION OF EMBODIMENTS

Figure 1:
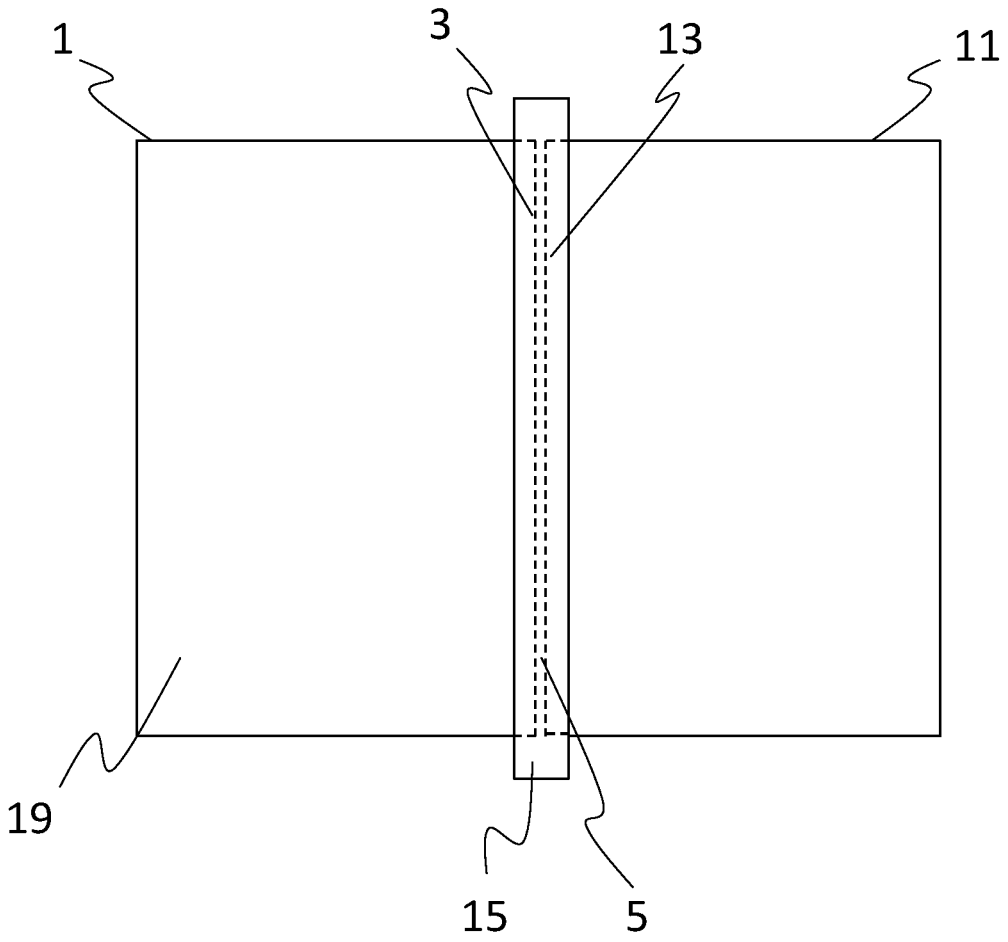
FIG. 1 shows schematically two panels which are sealed together according to one embodiment of the invention.

FIG. 1 shows schematically a first panel 1 and a second panel 11 which are sealed together according to one embodiment of the invention. An end side 3 of the first panel 1 is provided adjacent an end side 13 of the second panel 11 and a joint 5 to be sealed between the first and second panels 1, 11 is defined by the adjacent end sides 3, 13 of the two contiguous panels 1, 11. According to the invention the joint 5 is sealed by a first adhesive tape 15 and a second adhesive tape 17. The first tape 15 has been provided to a first face 19 of the two panels. Said first tape 15 seals the joint and is provided in the direction of the joint. The second tape 17 has been provided to a second face 21 of the two panels, wherein the second face 21 of the two panels is the opposite face to the first face 19 of the panels. Said second tape 17 seals the joint and is provided in the direction of the joint.

In this shown embodiment of the invention the first and second tapes 15, 17 have been provided along the whole length of the joint 5 and are also extending attached to each other outside the panels 1, 11 at both ends of the joint 5. The tapes could as well extend outside the panels on only one side. This extension of the tapes outside the panels on one or both sides of the panels is not necessary for the invention but will provide an extra durability to the sealing. When the two adhesive sides of the two tapes attach to each other outside the joint the risk that the tapes will be teared off is decreased. The double tape will also protect the panels from wearing, especially at the ends of the joint.

These two panels could be for example two ends of two different material stocks which should be connected. The material stocks could comprise any type of paper or cardboard such as for example cardboard used for corrugated boxes. The two panels could also be the two outermost side panels of a box template which is shown in FIGS. 2*a* and 2*b*.

Figure 2A:
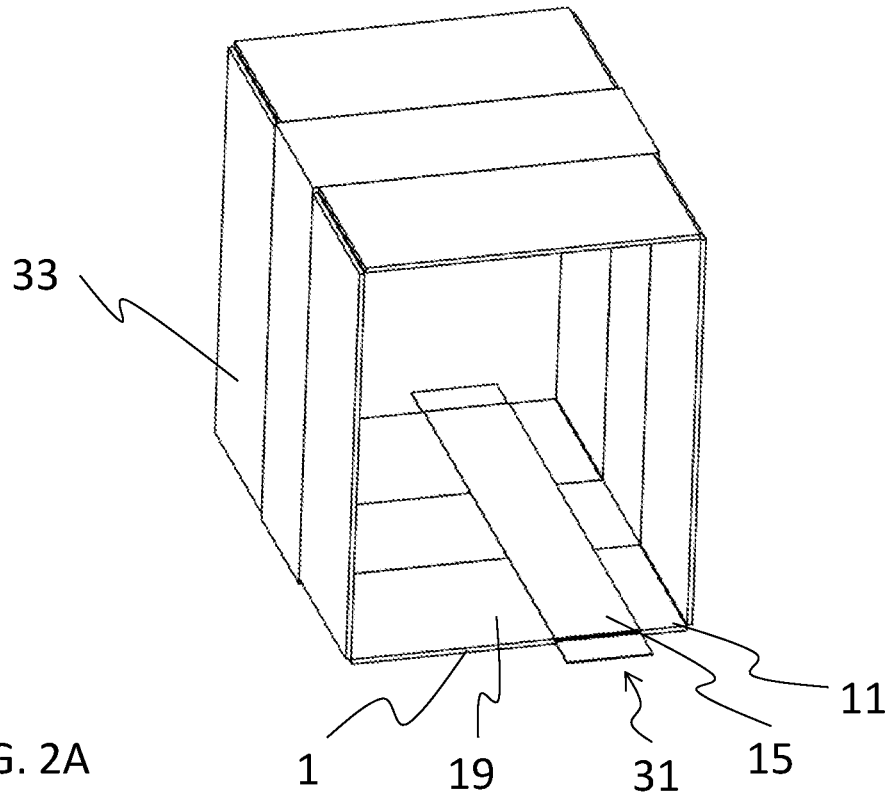
FIGS. 2*a* and 2*b* show schematically two views of a manufacturer's joint in a corrugated box which has been sealed according to one embodiment of the invention.
Figure 2B:
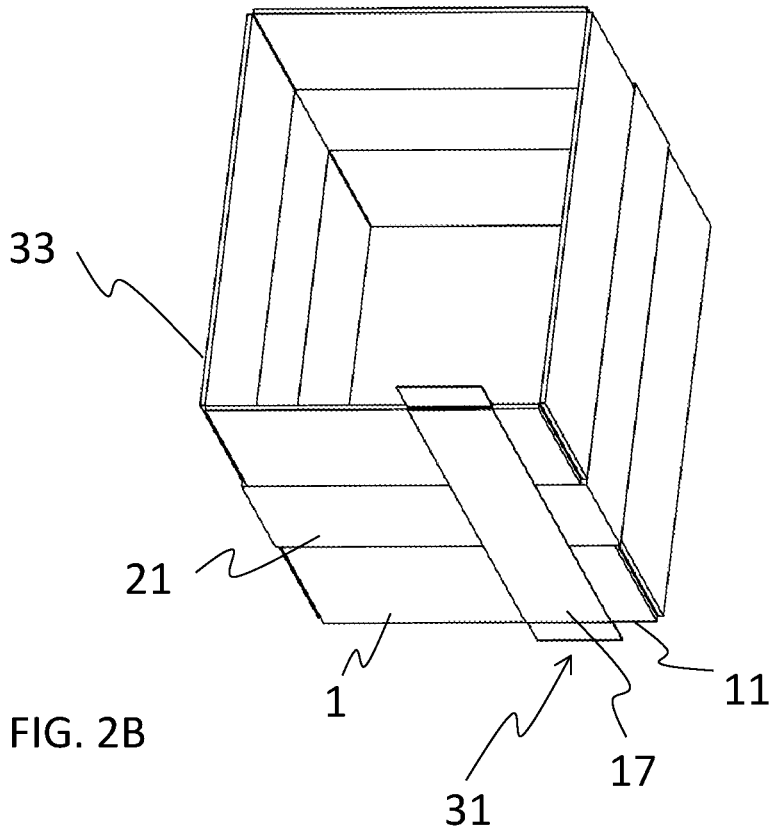

FIGS. 2*a* and 2*b* show schematically a manufacturer's joint 31 in a corrugated box 33 which has been sealed according to one embodiment of the invention. From a flat box template having creases and cuttings, such as for example an RSC, Regular Slotted Container, also known as Fefco 201, a box can be provided by folding and sealing. The two outermost side panels 1, 11 of the flat template will meet and constitute the manufacturer's joint 31. According to one embodiment of the invention the manufacturer's joint is sealed by a first tape 15 and a second tape 17 as described above. Top and bottom of the box can then be closed by folding and sealing the flaps at bottom and top towards each other. Bottom, top and side of a box can of course vary depending on how the box is positioned on a surface.

Figure 3:
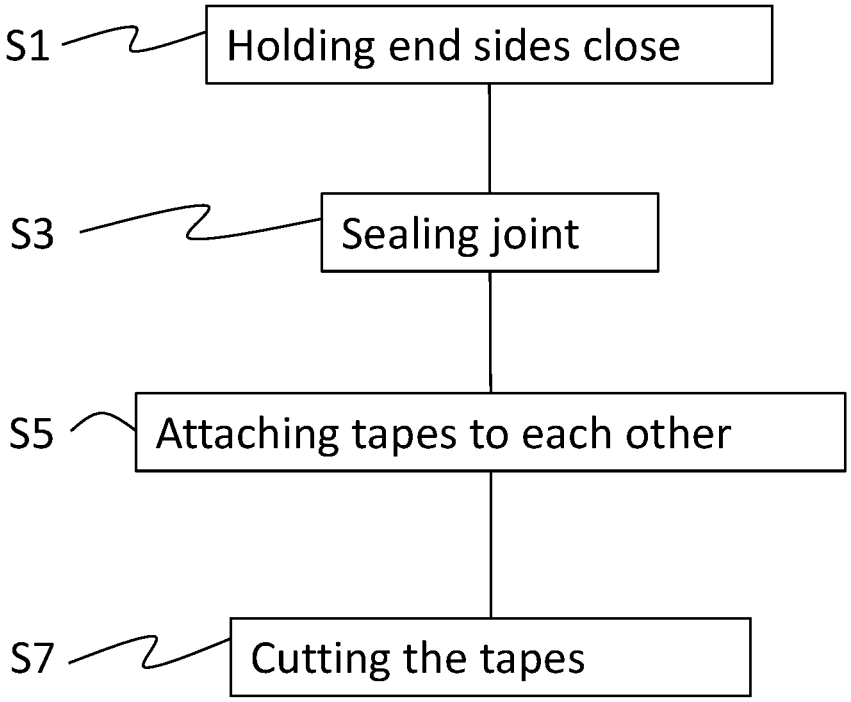
FIG. 3 is a flow chart of a method according to one embodiment of the invention.

FIG. 3 is a flow chart of a method for sealing a joint between two end sides of two contiguous panels 1, 11 according to one embodiment of the invention. The method steps are described in order below:

S1: Holding an end side of a first panel 1 close to an end side of a second panel 11, whereby the joint 5 to be sealed is defined by the adjacent end sides of the two panels.

S3: Sealing the joint with a first and a second adhesive tape 15, 17. A first tape 15 is provided to a first face 19 of the two panels. The first tape 15 seals the joint 5; 31 and is provided in the direction of the joint. A second tape 17 is provided to a second face 21 of the two panels, wherein the second face of the two panels is the opposite face to the first face of the panels. The second tape 17 seals the joint and is provided in the direction of the joint.

In one embodiment of the invention the step of sealing the joint 5, 31 with a first and a second tape 15, 17 further comprises providing the first and second tapes over the whole length of the joint and further extending a distance outside the panels 1, 11 and wherein the method further comprises a step S5 of attaching the two tapes to each other where the tapes are extending outside the joint.

In one embodiment of the invention the step of sealing the joint with a first and a second tape comprises providing the first and second tapes to the joint simultaneously.

The step of sealing the joint comprises in one embodiment of the invention passing the panels between two connected tape dispensers. Either the tape dispensers are kept stationary and the panels are advanced between them or alternatively the panels can be kept stationary and the two connected tape dispensers can be moved such that the panels are passing between the two connected tape dispensers.

In one embodiment of the invention the method further comprises the step S7 of cutting the tapes off. This can be done by automatically releasing a cutter for cutting the tapes off after the sealing of the joint when the tape dispensers are at a certain distance from the panels. However, in another embodiment the tapes can be cut off manually.

FIGS. 4-8 show different views of a sealing device 51 according to one embodiment of the invention. This is an example embodiment of the invention and many of the details shown in this embodiment are not necessary for the invention and can be varied within the scope of the invention which will be realized by the skilled person and which will be further discussed below.

Figure 4:
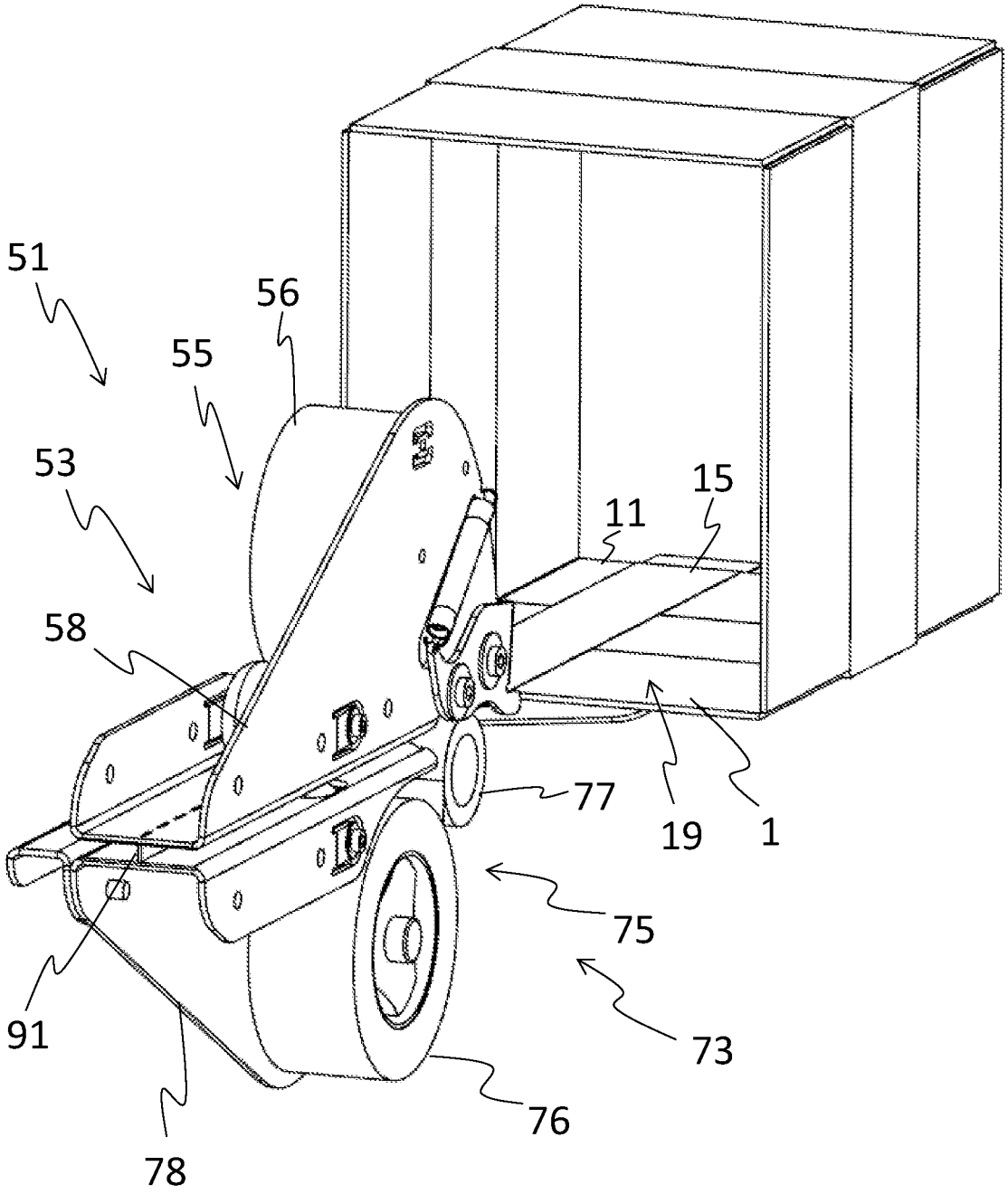
FIG. 4 shows a perspective side view of a sealing device according to one embodiment of the invention.
Figure 7:
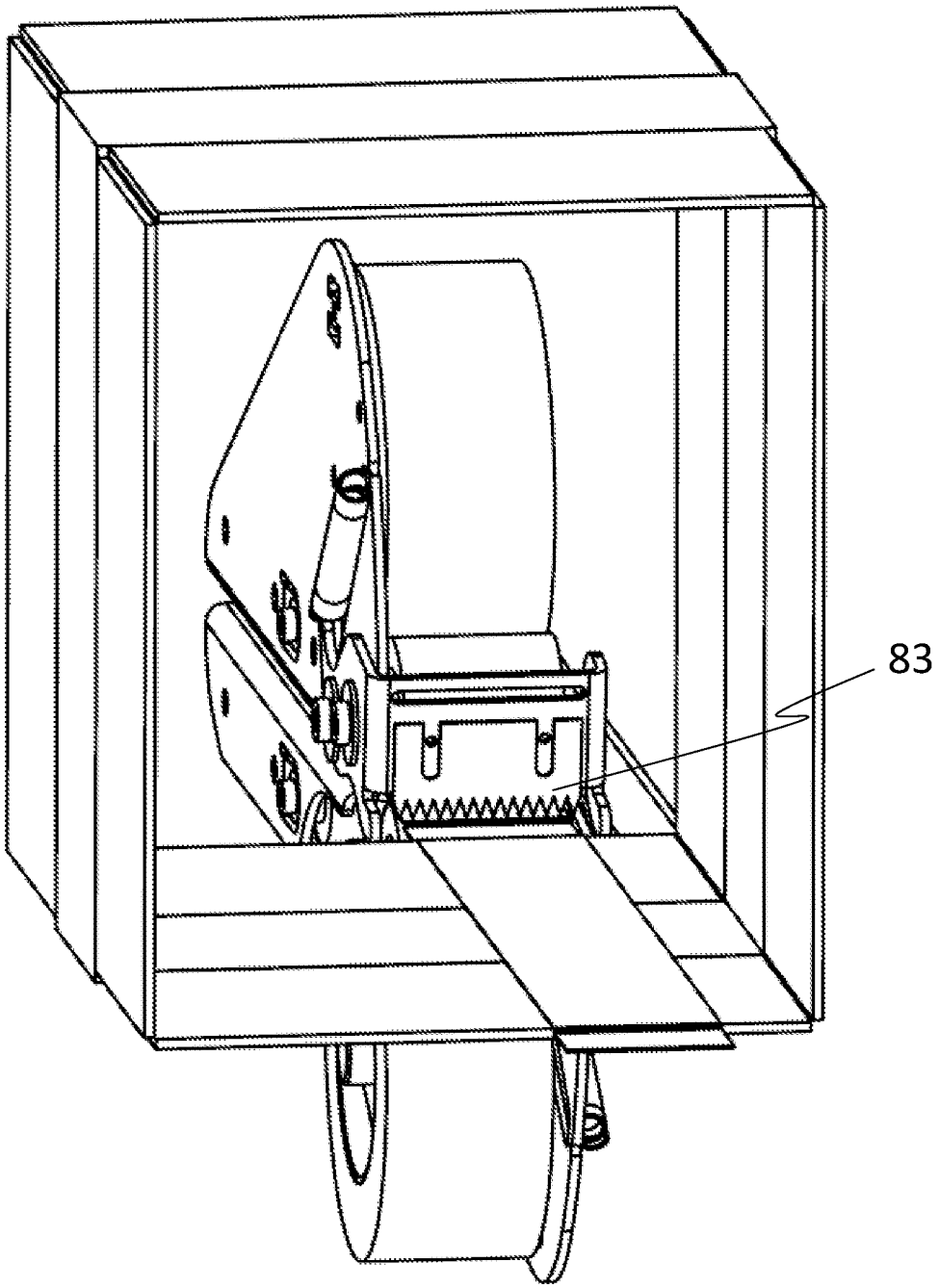
FIG. 7 shows a perspective view from the front of the sealing device shown in FIGS. 4-6.
Figure 8:
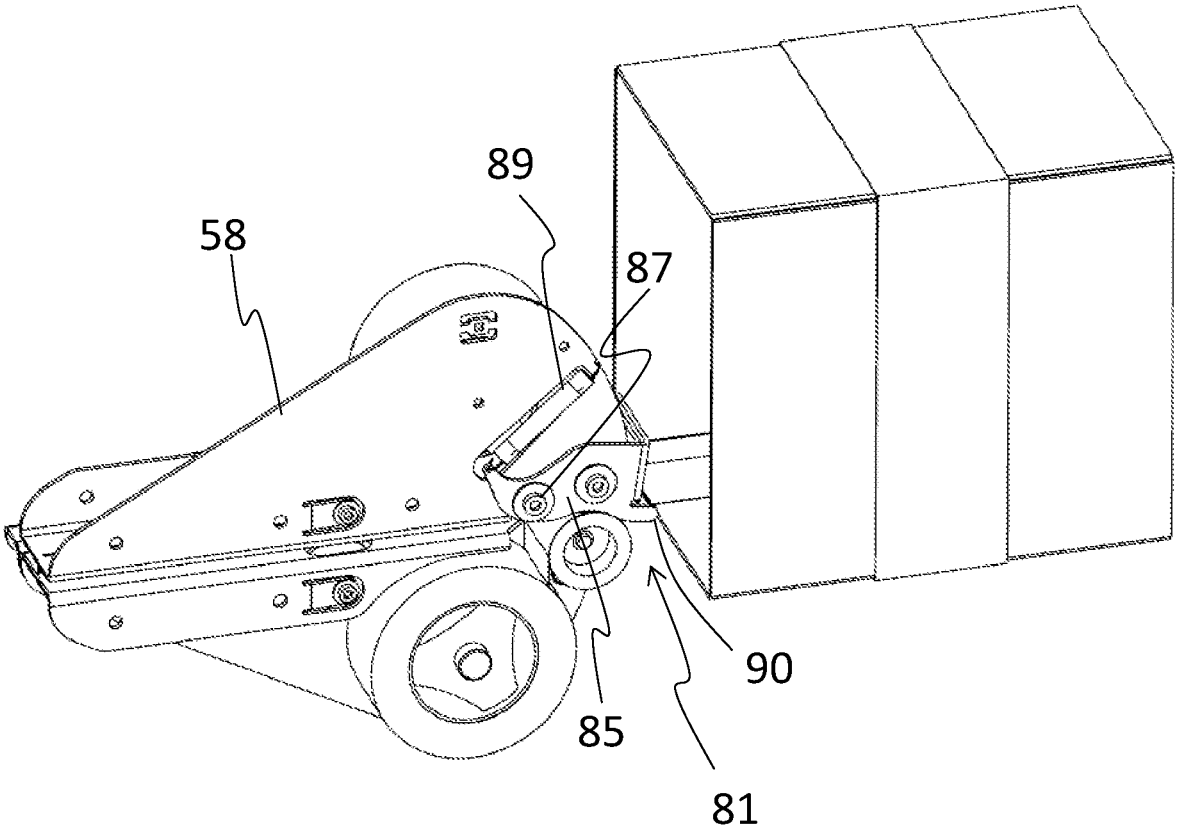
FIG. 8 shows a perspective side view of the sealing device shown in FIGS. 4-7.

FIG. 4 shows a perspective side view of a sealing device 51 for sealing a joint 5 between two end sides of two contiguous panels according to one embodiment of the invention. The panels could be any kind of panels and it could be two panels in a corrugated box template which is shown in FIGS. 4, 7 and 8 (and which was discussed above). The sealing device 51 comprises a first part 53 and a second part 73. The first part 53 comprises a first tape dispenser 55 arranged for providing a first adhesive tape 15 to a first face 19 of the two panels, said first tape sealing the joint 5 and being provided in the direction of the joint when the two panels 1, 11 are passing through the sealing device 51. The second part 73 comprises a second tape dispenser 75 arranged for providing a second tape 17 to a second face 21 of the two panels, wherein the second face 21 of the two panels is the opposite face to the first face 19 of the panels, said second tape sealing the joint and being provided in the direction of the joint when the two panels are passing through the sealing device 51. The first and second parts 53, 73 of the sealing device 51 are connected to each other such that the first and second tapes 15, 17 are provided simultaneously to the panels when the panels 1, 11 are passing between the first and second parts 53, 73 of the sealing device thereby sealing the joint from both faces of the panels. Above, in the rest of the description and in the claims it is referred to the panels "passing" through the sealing device or between the first and second parts of the sealing device. This is meant to cover both a stationary sealing device where the panels are moving through the sealing device and stationary panels where the sealing device is moved such that the panels are passing though the sealing device.

The first and second parts 53, 73 of the sealing device are in this embodiment of the invention connected to each other through a transverse member 91 such that the two panels to be joined can be passing between the first and second parts 53, 73 with the transverse member 91 fitting in the joint 5. Hereby there will be a distance between the two panels in the joint which distance corresponds substantially to a width of the transverse member 91. The transverse member 91 will be described in more detail below.

Figure 5:
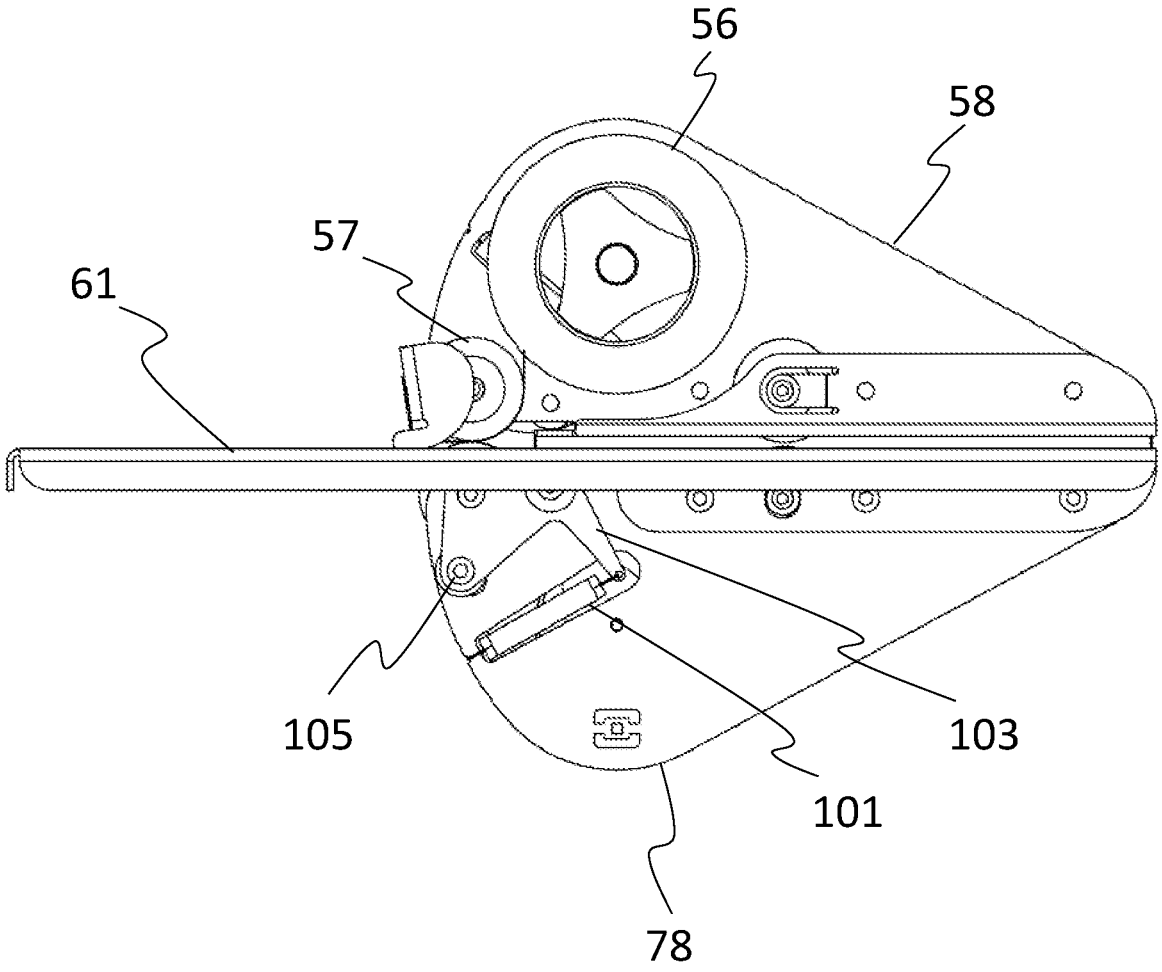
FIG. 5 shows a side view of the sealing device shown in FIG. 4.

The first and second tape dispensers 55, 75 each comprises a tape roll 56, 76 and an applicator roll 57, 77, whereby tape from the tape roll 56, 76 is provided onto the panels 1, 11 by the applicator roll 57, 77 (see also FIG. 5). The applicator roll 57 of the first part 53 and the applicator roll 77 of the second part 73 will in one embodiment contact each other but still allowing the two panels 1, 11 and the tapes to pass between them whereby the first and second tapes 15, 17 will be provided to the panels while they are passing between the applicator rolls 57, 77. In one embodiment at least one of the applicator rolls 57 or 77 can be spring loaded such that this applicator roll 57 or 77 can be forced away from the other one of the applicator rolls 57 or 77 when the panels are forced between the two applicator rolls 57, 77. This can be seen in FIG. 5 which shows a side view of the sealing device 51 of FIG. 4. In this embodiment the applicator roll 77 of the second part 73 is spring loaded. The applicator roll 77 is connected to one end of a lever 103 which can pivot around a fastening means 105 which will fasten the lever to a mounting surface 78 (see further description below) of the second part 73. The lever 103 is in its other end connected to a spring 101 such that the applicator roll 77 can be forced down by the panels passing between the two applicator rolls 57, 77 while the spring is loaded and when the panels have passed out from the sealing device the applicator roll 77 will return to a position closer to the applicator roll 57 of the first part 53 because the spring is returning to an unloaded position. By this spring loading of at least one of the applicator rolls the tapes are provided to the panels with a force towards the panels which is suitable. Furthermore by this spring loading of at least one of the applicator rolls the tapes extending outside the panels will be attached to each other. An alternative to spring loading one of the applicator rolls can be to provide the applicator rolls in a deformable material which will allow the panels to pass between the applicator rolls.

Also seen in FIG. 5 is a supporting arm 61 extending out from the sealing device. This is an optional feature of the device. The panels/box whose joint has been sealed by the sealing device may rest on this supporting arm right after the sealing procedure and this may facilitate a cutting of the tapes.

The first part 53 of the sealing device comprises a first mounting surface 58 onto which the tape roll 56 and the applicator roll 57 of the first tape dispenser 55 are mounted and the second part 73 of the sealing device 51 comprises a second mounting surface 78 onto which the tape roll 76 and the applicator roll 77 of the second tape dispenser 75 are mounted. The first and second mounting surfaces 58, 78 comprises in this embodiment at least one part each which is provided substantially perpendicular to the surface of the panels 1, 11 when they are passing through the sealing device 51. The tape rolls and applicator rolls are mounted to these perpendicular parts of the mounting surfaces 58, 78.

A cutter arrangement 81 is in one embodiment of the invention provided to either the first part 53 or the second part 73 of the sealing device 51. In the embodiment shown in FIGS. 4-8 the cutter arrangement 81 is provided to the first part 53 of the sealing device 51. The cutter arrangement 81 is best seen in FIGS. 7 and 8. The cutter arrangement 81 is arranged for cutting the two tapes off when the panels 1, 11 have passed between the two parts 53, 73 of the sealing device 51 and the two tapes have been provided along the whole length of the joint. In the embodiment shown in FIGS. 4-8 a cutting part 83 of the cutter arrangement 81 is shown provided in front of the applicator roll 57 of the first part 53. The cutter arrangement 81 is in this embodiment provided spring loaded such that it will automatically cut the tapes off at a certain distance from the panels when the panels have passed between the two parts of the sealing device. The spring loading of the cutter arrangement is however not necessary for the invention. In this embodiment of the invention which is shown in the FIGS. 4-8, the cutting part 83 is connected to one end of a lever 85 which can pivot around a pivot point which can be a fastening means 87 which is fastening the lever to the mounting surface 58 of the first part 53. The lever 85 is connected in its other end to a spring 89 such that the cutting part 83 is provided in a cutting position when the spring 89 is released. The lever 85 comprises further in the same end of the lever 85 as the cutting part 83 an extending part 90 which extends from the cutter arrangement 81 away from the sealing device. The extending part 90 is configured for sliding over the surface of the panels when they are passing through the sealing device. The panels are hereby, through the extending part 90, pushing on the lever such that the cutting part 83 is elevated above the tapes into an inactive position. The spring 89 is now in a loaded position. Hereby the cutting part 83 is forced into an inactive position, i.e. a position in which the tapes are not cut off, during the time when the panels 1, 11 are passing between the first and second parts 53, 73 of the sealing device 51. When the panels have moved out from the sealing device the extending part 90 at a certain position of the panels loses contact with the panels and moves down together with the cutting part 83 because the spring is released. The cutting part is now in a cutting position and cuts the tapes off. The length of the extending part 90 hereby decides where the tapes are cut. As discussed above the tapes can suitably extend a distance outside the panels (as shown in FIGS. 1 and 2). The extending part 90 and the cutting part 83 and the distance of the cutting part 83 from the applicator roll can be designed such that the tapes will extend the same length outside the panels on both sides after sealing of the joint.

In one embodiment of the invention at least one of the applicator rolls 57, 77 can be motor driven to facilitate the passing of the panels through the sealing device 51. This is not shown in the figures but a skilled person would understand how to provide an axis and a motor to one of the applicator rolls for rolling it. A sensor could also be provided in connection with the motor. The sensor could detect the presence of panels within the sealing device and the motor could be controlled to roll the applicator roll based on these sensor signals.

Figure 6:
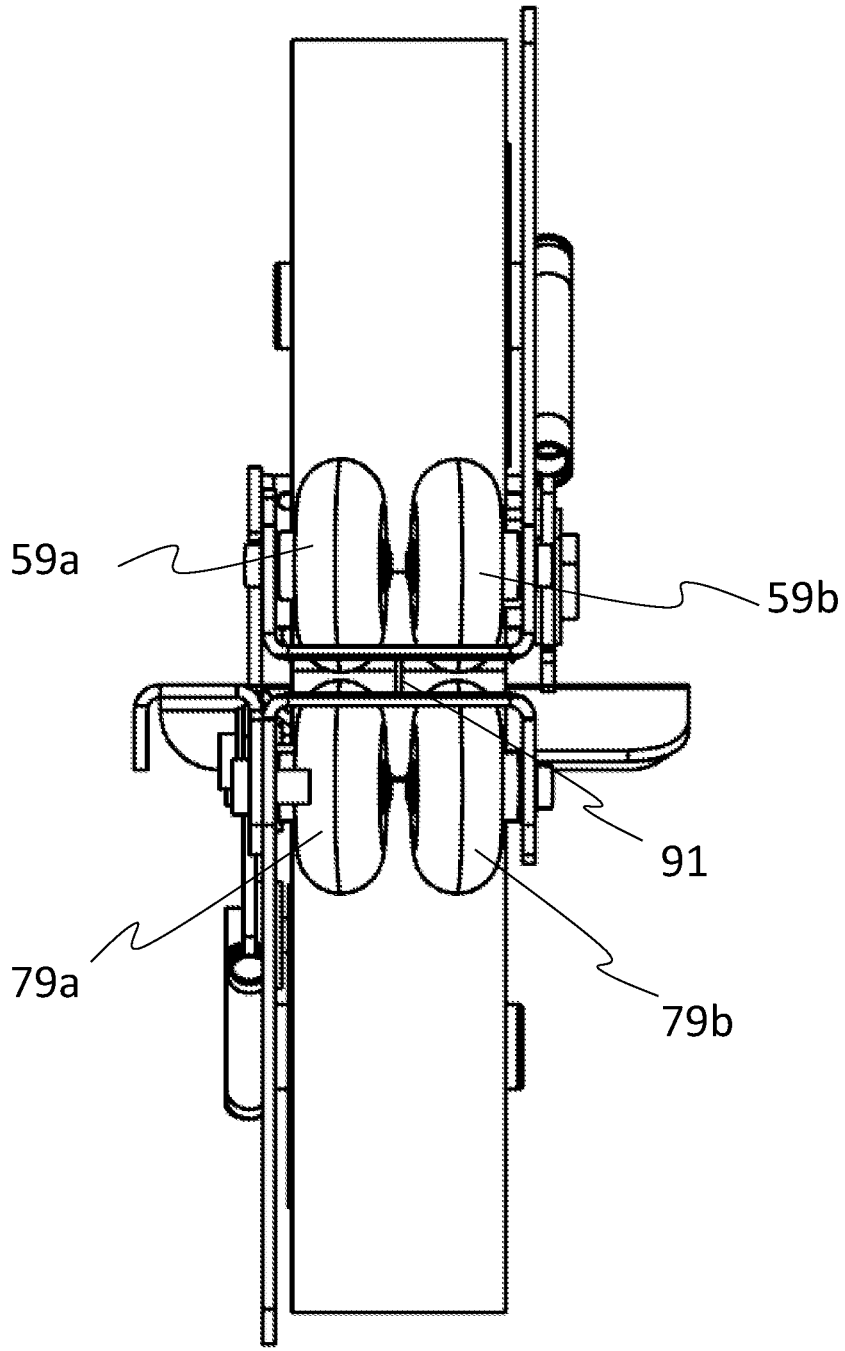
FIG. 6 shows a back view of the sealing device shown in FIGS. 4 and 5.

FIG. 6 shows the sealing device 51 of FIGS. 4-6 from behind. In this view the transverse member 91 can be seen. The transverse member 91 is connected in one of its ends to a part of the mounting surface 58 of the first part, which part of the mounting surface is parallel to the surface of the panels when they are passing through the sealing device and the transverse member 91 is connected in its other end to a part of the mounting surface 78 of the second part of the sealing device which part of the mounting surface is parallel to the surface of the panels when they are passing through the sealing device. In FIG. 6 it can also be seen that two guiding wheels 59*a, b* and 79*a, b* are provided to both the first and second parts 53, 73 of the sealing device 51 in this embodiment. These guiding wheels 59*a, b* and 79*a, b* are positioned on the other side of the tape roll 56, 76 compared to the applicator roll 57, 77. The guiding wheels 59*a, b*, 79*a, b* are arranged to protrude into the opening between the first and second parts 53, 73 through which the panels will be passing but they will not close the opening completely but leave a passage for the panels. The guiding wheels will touch the panels and guide them towards each other because the guiding wheels are slightly oblique pointing towards each other in the direction of passing of the panels through the sealing device. The two guiding wheels 59*a, b* and 79*a, b* are provided one on each side of the transverse member 91. Hereby the panels 1, 11 will be kept in a correct position during the passing of the panels through the sealing device 51 and the end sides of the panels will be kept together during the sealing procedure. These guiding wheels are however not necessary for the invention.

FIG. 7 shows the sealing device as shown in FIGS. 4-6 in perspective from the front. Here it can be seen where the cutting part 83 of the cutter arrangement 81 cuts the tapes. It can also be seen how the tapes are provided to the manufacturer's joint of the box.

FIG. 8 is a perspective view of the sealing device shown in FIGS. 4-7 where the cutter arrangement 81 is seen together with a box. In this position, where the box just is moving out from the sealing device it can be seen that the extending part 90 of the cutter arrangement 81 loses contact with the panels and moves down together with the cutting part 83 because of the spring force.

The invention claimed is:

1. A sealing device for sealing a joint between two end sides of two contiguous panels, said sealing device comprising:

a first part comprising a first tape dispenser arranged for providing a first adhesive tape to a first face of the two panels, said first tape sealing the joint and being provided in the direction of the joint when the two panels are passing through the sealing device; and a second part comprising a second tape dispenser arranged for providing a second tape to a second face of the two panels, wherein the second face of the two panels is the opposite face to the first face of the panels, said second tape sealing the joint and being provided in the direction of the joint when the two panels are passing through the sealing device;

wherein said first and second parts of the sealing device are connected to each other such that the first and second tapes are provided simultaneously to the panels when the panels are passing between the first and second parts of the sealing device thereby sealing the joint from both faces of the panels, and wherein the first and second parts of the sealing device are connected to each other by a transverse member such that the two panels to be joined can be passing between the first and second parts with the transverse member fitting in the joint, hereby there will be a distance between the two panels in the joint which distance corresponds substantially to a width of the transverse member.

2. Sealing device according to claim 1, wherein the first and second tape dispensers each comprises a tape roll and an applicator roll, whereby tape from the tape roll is provided onto the panels by the applicator roll and the two applicator rolls will be provided close to each other allowing the two panels to pass between them whereby the first and second tapes will be provided to the panels while they are passing between the applicator rolls.

3. Sealing device according to claim 2, wherein at least one of the applicator rolls is provided spring loaded such that by loading a spring the spring loaded applicator roll can be forced away from the other applicator roll thus allowing the panels to pass between the applicator rolls.

4. Sealing device according to claim 1, further comprising a cutter arrangement arranged for cutting the two tapes at a certain distance from the panels.

5. Sealing device according to claim 4, wherein the cutter arrangement is spring loaded and comprises an extending part arranged for sliding over a surface of the panels when they are passing through the sealing device, said extending part keeping a cutting part of the cutter arrangement in an inactive position as long as the extending part is in contact with the panels and when the panels have passed the sealing device and the extending part no longer is in contact with the panels the spring force will bring the cutting part into a cutting position where the two tapes are cut off.

6. Sealing device according to claim 1, wherein at least one of the applicator rolls is driven by a motor which can be controlled in dependence of output from a sensor which can detect the presence of a panel in the sealing device.

7. Sealing device according to claim 1, further comprising guiding wheels protruding into an opening between the first and second parts which opening the panels are passing through during sealing of the joint, said wheels being oriented for guiding the two panels towards each other during their passing through the sealing device.

8. A sealing device for sealing a joint between end sides of two panels, the sealing device comprising:

a first part comprising a first mounting surface and a first tape dispenser mounted on the first mounting surface, the first tape dispenser being configured to apply a first adhesive tape to a first face of the two panels to seal the joint; and a second part comprising a second mounting surface and a second tape dispenser mounted on the second mounting surface, the second tape dispenser being configured to apply a second adhesive tape to a second face of the two panels to seal the joint; and a transverse member connected between the first part and the second part, such that the end sides of the two panels can pass between the first and second parts with the transverse member disposed between the end sides of the two panels, such that a distance between the end sides of the two panels in the joint corresponds substantially to a width of the transverse member.

9. The sealing device of claim 8, wherein the second face of the two panels is opposite to the first face of the two panels.

10. The sealing device of claim 8, wherein the first and second parts are configured to apply the first and second tapes to the two panels in a direction generally parallel to the length of the joint.

11. The sealing device of claim 8, wherein the first and second parts of the sealing device are configured to apply the first and second tapes to the two panels substantially simultaneously.

12. The sealing device of claim 8, further comprising one or more guiding wheels protruding into an opening between the first and second parts, the opening being configured to have the end sides of the two panels pass therethrough during sealing of the joint.

13. The sealing device of claim 12, wherein the one or more guiding wheels being oriented for guiding the end sides of the two panels towards each other as the end sides of the two panels pass through the sealing device.

14. The sealing device of claim 8, further comprising a cutter arrangement configured to cut the first and second tapes at a certain distance from the two panels.

15. The sealing device of claim 14, wherein the cutter arrangement is spring-loaded and comprises an extending part configured to slide over a surface of the two panels when the two panels pass through the sealing device, the extending part being configured to keep a cutting part of the cutter arrangement in an inactive position as long as the extending part is in contact with the two panels and when the two panels have passed through the sealing device and the extending part is no longer in contact with the two panels, the spring force being configured to bring the cutting part into a cutting position to cut the first and second tapes.

16. The sealing device of claim 8, wherein each of the first and second tape dispensers comprises a tape roll and an applicator roll, the applicator roll being configured to apply tape from the tape roll onto the panels.

17. The sealing device of claim 16, wherein at least one of the applicator rolls is spring-loaded to move the applicator roll away from the other applicator roll to allow for the two panels to pass through the sealing device.

18. A sealing device for sealing a joint between end sides of two panels, the sealing device comprising:

a first part comprising a first mounting surface and a first tape dispenser mounted on the first mounting surface, the first tape dispenser being configured to apply a first adhesive tape to a first face of the two panels to seal the joint; and a second part comprising a second mounting surface and a second tape dispenser mounted on the second mounting surface, the second tape dispenser being configured to apply a second adhesive tape to a second face of the two panels to seal the joint;

a transverse member connected between the first part and the second part, such that the end sides of the two panels can pass between the first and second parts with the transverse member disposed between the end sides of the two panels, such that a distance between the end sides of the two panels in the joint corresponds substantially to a width of the transverse member;

one or more guiding wheels protruding into an opening between the first and second parts, the opening being configured to have the end sides of the two panels pass therethrough during sealing of the joint, the one or more guiding wheels being configured to guide the end sides of the two panels towards each other as the end sides of the two panels pass through the sealing device; and a cutter arrangement configured to cut the first and second tapes after the first and second tapes are applied to the two panels.

19. The sealing device of claim 8, wherein the first and second parts are configured to apply the first and second tapes to the two panels in a direction generally parallel to the length of the joint.

20. The sealing device of claim 8, wherein the first and second parts of the sealing device are configured to apply the first and second tapes to the two panels substantially simultaneously.

* * * * *